United States Patent [19]

Wood

[11] Patent Number: 4,867,575

[45] Date of Patent: Sep. 19, 1989

[54] PLASTIC BAG WITH STRAP-TYPE CARRYING HANDLE

[75] Inventor: Jerry W. Wood, Kent, Wash.

[73] Assignee: Cello Bag Company, Inc., Seattle, Wash.

[21] Appl. No.: 276,206

[22] Filed: Nov. 23, 1988

[51] Int. Cl.[4] ..... B65D 33/06; B65D 33/08; B65D 33/10

[52] U.S. Cl. ..... 383/17; 383/21; 383/25; 383/29; 383/10; 493/226

[58] Field of Search ..... 383/17, 21, 25, 10, 383/29; 493/226

[56] References Cited

U.S. PATENT DOCUMENTS

| | | | |
|---|---|---|---|
| 3,370,630 | 2/1968 | Haugh et al. | 150/12 |
| 4,252,269 | 2/1981 | Peppiatt | 383/25 |
| 4,539,705 | 9/1985 | Baines | 383/21 |
| 4,550,439 | 10/1985 | Peppiatt | 383/21 |
| 4,573,203 | 2/1986 | Peppiatt | 383/8 |
| 4,713,839 | 12/1987 | Peppiatt | 383/29 |
| 4,730,943 | 3/1988 | Johnson | 383/25 |
| 4,781,474 | 11/1988 | Sengewald | 383/29 |

FOREIGN PATENT DOCUMENTS

| | | |
|---|---|---|
| 2155091 | 5/1972 | Fed. Rep. of Germany . |
| 2157072 | 6/1973 | Fed. Rep. of Germany . |
| 2053590 | 4/1971 | France . |

OTHER PUBLICATIONS

"Nonwovens and Disposables: Proceedings of 1st Canadian Symposium on Nonwovens and Disposables", Mar. 15–16, 1977, Technomic Publishing Co.

*Primary Examiner*—Stephen P. Garbe
*Attorney, Agent, or Firm*—Delbert J. Barnard

[57] ABSTRACT

A handle web (14) is heat sealed to the gusset end of a bag web (10). The bag is a bottom filled top gusset bag which assumes a carton shape when filled. The handle web (14) has a central portion which extends over the gusset (18). Substantially D-shaped hand openings (16, 18) are formed in the handle web (14). These openings (16, 18) have inwardly-directed arcuate sides (60, 62) and substantially flat outwardly-directed sides (64, 66). Rounded corners (68, 70, 72, 74) are formed where the arcuate sides (60, 62) meet the flat sides (64, 66). This construction results in a four-sided stretching of the handle web when under load, along smoothly curving arcuate paths, providing good stress distribution in the handle web material and the elimination of tear-inducing stress concentrations.

4 Claims, 5 Drawing Sheets

Fig. 7
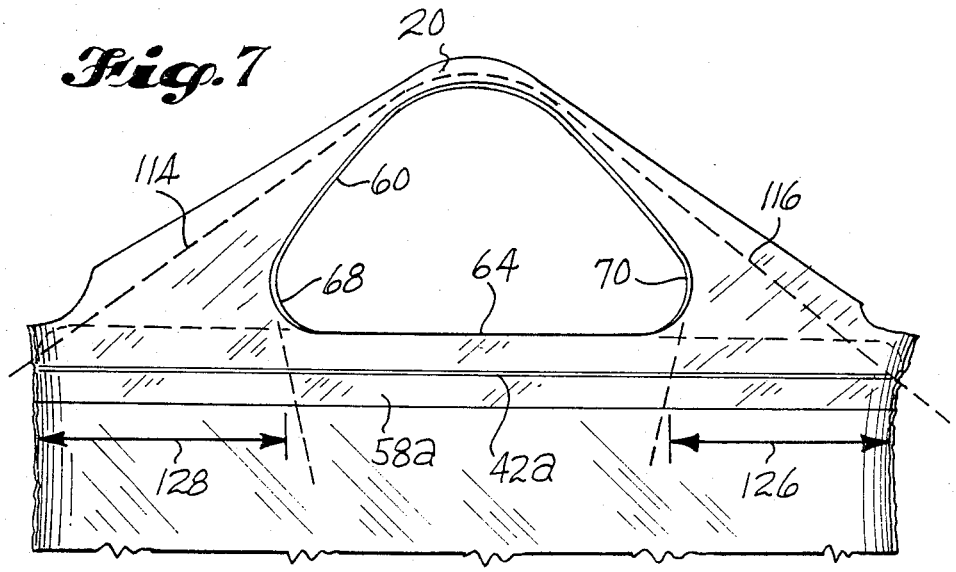
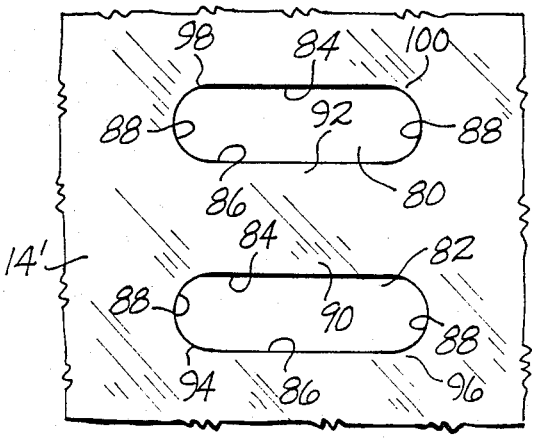
Fig. 8
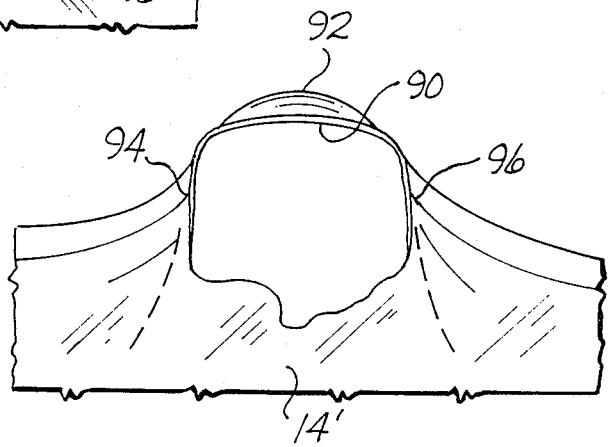
Fig. 9

PLASTIC BAG WITH STRAP-TYPE CARRYING HANDLE

DESCRIPTION

1. Technical Field

This invention relates to bottom loaded plastic bags which have a closed top and a carton look when filled. More particularly, it relates to the provision of an improved strap type handle for such a bag.

2. Background Art

Cubic bag packages which simulate a carton have become quite popular for packaging disposable infant diapers and adult briefs. These bags make it possible to create the "carton" look, with a similar degree of packaging line automation, but with a much reduced material cost. The bag offers nearly 100% surface availability for graphics, a perfectly contoured fit, and additional features such as add-on carrying handles. Also, the filled bags are readily stackable. A good background description of these bags appears in the article entitled, "Poly Bag Packaging for Disposable and Nonwoven Products," by A. G. Thatcher, published Mar. 15, 1977 in Montreal, Canada. Reprints of this article are available from Technomic Publishing Co., Inc. of Westport, Conn.

A popular form of "cubic" bag, equipped with a "loop" type carrying handle, is disclosed by German Patent Publication No. 2,155,091, published May 10, 1972. This same bag and handle are disclosed in U.S. Pat. No. 3,370,630, granted Feb. 27, 1968, except that the bag is not shown in a full pack condition and the top of the bag is not accurately drawn. French Patent Publication No. 2,053,590, published on Apr. 16, 1971 also relates to a cubic bag and discloses three styles of carrying handles, each of which has opposite side portions which are heat sealed to the bag where the gusset meets the front and rear walls of the bag. One of the handles is a strap handle which extends longitudinally of the gusset between two elongated hand openings.

It is known to heat seal a handle web to a bag web and then cut the handle web to form the desired handle shape. German Patent Pub. No. 2,157,072, published June 7, 1973, discloses the use of this method in the manufacture of a flat bag. U.S. Pat. No. 4,573,203, granted Feb. 25, 1986 to Harry R. Peppaitt, discloses the use of this method for providing a loop handle at the gusset end of a cubic bag.

U.S. Pat. No. 4,539,705, granted Sept. 3, 1985, to Patrick A. Baines discloses a cubic bag having a strap-like handle which extends lengthwise of the gusset. The ends of the handle are connected to the end walls of the filled bag. This patent sets forth a very comprehensive description of the various types of cubic bags which have been used for packaging disposable diapers and similar products.

The principal object of the present invention is to provide a bottom loaded cubic bag, for use to package disposable diapers and similar products, having a strap-like handle which extends longitudinally of the gusset and is attached to upper side corner regions of the bag, and which is configured to eliminate tear inducing stress concentrations in the handle.

DISCLOSURE OF THE INVENTION

According to the present invention, an improved strap-type carrying handle is provided at the gusset end of a bottom loaded cubic bag. The bag is formed from a web of thermoplastic material which is folded laterally on itself to form front and rear panels and a top gusset between the panels at one end of the bag. Side seals connect the side edges of the bag panels together and connect the end edges of the top gusset together and to the upper portions of the side edges of the bag panels. This results in the bag when filled assuming a cubic or carton shape, with the gusset becoming substantially flat and forming a closed top for the bag. A handle web of thermoplastic material is connected to the gusset end of the bag. The handle web has opposite edge portions and a central portion which overlies the gusset. Connecting seals connect the edge portions of the handle web to the front and rear panels of the bag web adjacent the top gusset. The central portion of the handle web includes a pair of hand openings, each of which includes an arcuate inner side of continuous concave curvature, an outer side, and rounded corners where the arcuate inner side meets the outer side. An elongated strap handle region is defined by and laterally between the hand openings. The handle web includes opposite end regions which extend both endwise and laterally outwardly from the opposite ends of the strap handle, to upper side corner regions of the bag. This construction of the handle web, and in particular the arcuate shape of the inner sides of the hand openings, results in the stress carrying regions of the handle web assuming a smoothly curving arcuate shape, when under load, with a good stress distribution throughout and the elimination of tear-promoting stress concentrations.

Various further objects, advantages and features of the invention are hereinafter described as a part of the description of the best mode or preferred embodiment.

BRIEF DESCRIPTION OF THE DRAWINGS

In the drawings, like reference letters and numbers refer to like parts throughout the various views, and:

FIG. 7 is a fragmentary side view of the upper portion of the bag in the condition shown by FIG. 6, showing the stretch pattern of the handle and the pattern of force distribution between the bag material and the handle material where they are heat sealed together;

FIG. 8 is a fragmentary top plan view of a handle web which includes hand openings of conventional shape; and FIG. 9 is a view like FIG. 7, showing the stretch pattern of the handle and the stress concentration regions which result from the use of the hand holes of conventional shape.

BEST MODE FOR CARRYING OUT THE INVENTION

Figure 1:
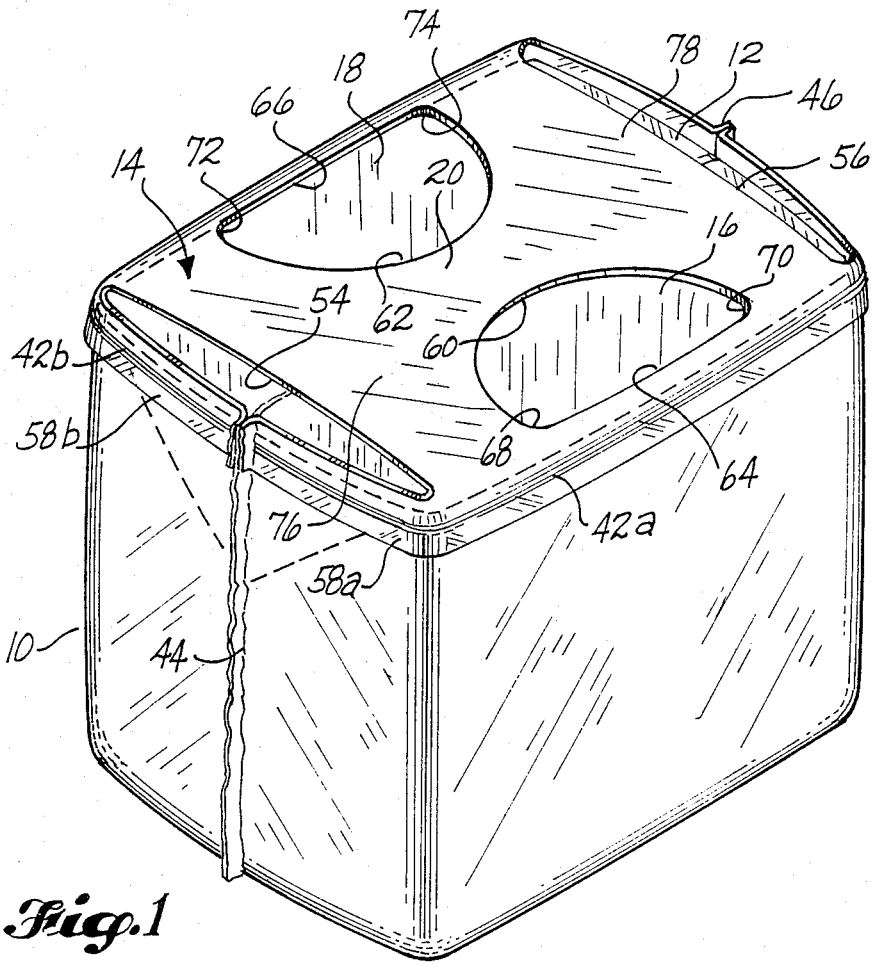
FIG. 1 is a pictorial view of a filled plastic bag embodying the invention, in a static condition, such view looking from above and towards the top, one side and one end of the bag.

The handle bag of the present invention is a cubic or carton type bag 10, having an upwardly-directed gusset 12. It includes a handle formed in a handle web 14 which overlies the gusset 12. As will hereinafter be described, distinctively-shaped hand openings 16, 18 are formed in a central portion of the handle web 14. A strap handle 20 is formed between the opening 16, 18. The distinctive shape of the hand opening 16, 18 results in an improved stress distribution in the handle web 14 attended by an improved weight distribution between the bag and handle 20 when the bag is filled and the handle 20 is stressed.

Preferably, the handle bag is constructed in the following manner. A bag web is folded laterally on itself and then the fold is tucked inwardly to form a double fold or gusset 12. The gusset 12 includes an inner fold 22 and two outer folds 24, 26. The handle web 14 is folded laterally on itself to form front and rear panels 28, 30 which are connected together by a fold 32. The bag web, when folded in the manner described, comprises front and rear bag panels 34, 36 and front and rear gusset panels 38, 40. The free edges of the handle web panels 28, 30 are positioned to overlap edge portions of the bag panels 34, 36 which border the folds 24, 26. The lapped portions of the handle web panels 28, 30 and the bag panels 34, 36 are heat sealed together along a continuous heat seal 42 which extends parallel to the folds 22, 24, 26, 32. The bag and handle webs are folded and heat sealed together while the two webs are in motion. Then, the forward portion of the connected webs is stopped and a discrete bag is delineated and separated from the connected webs. Specifically, the handle web is cut to form the handle shape and provide the hand openings 16, 18. At the same time a bag is cut off from the end of the connected webs and a side seal is formed where the cut is made. The side seals for the illustrated bag are designated 44, 46.

Figure 2:
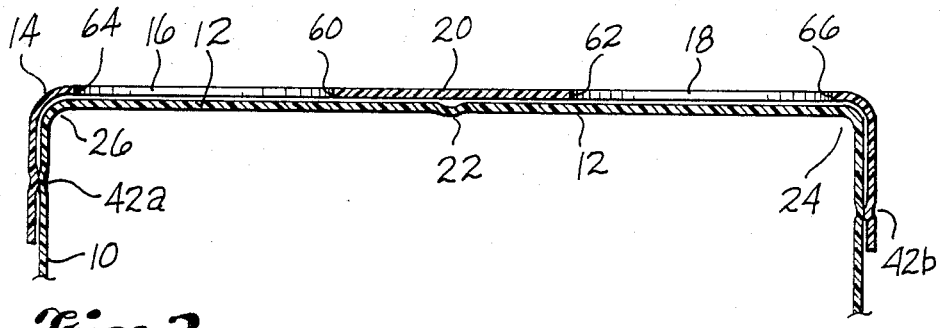
FIG. 2 is a sectional view taken substantially along line 2—2 of FIG. 5.
Figure 4:
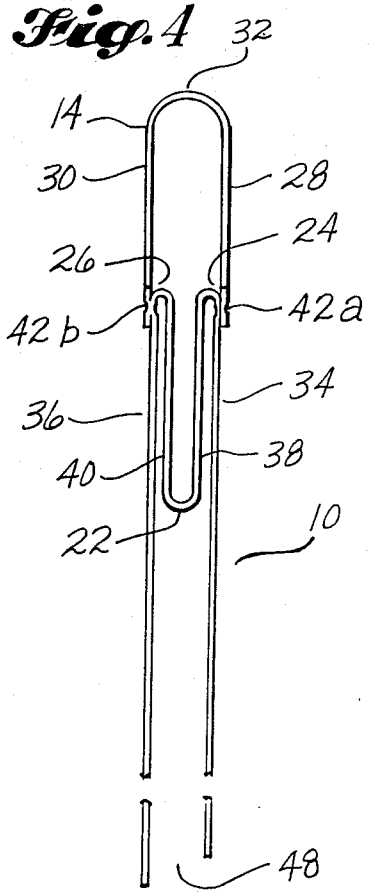
FIG. 4 is an enlarged scale sectional view taken substantially along line 4—4 of FIG. 3, showing space between the panels of the bag and the handle, so as to more clearly illustrate these portions of the bag and handle and their relationship to each other.
Figure 3:
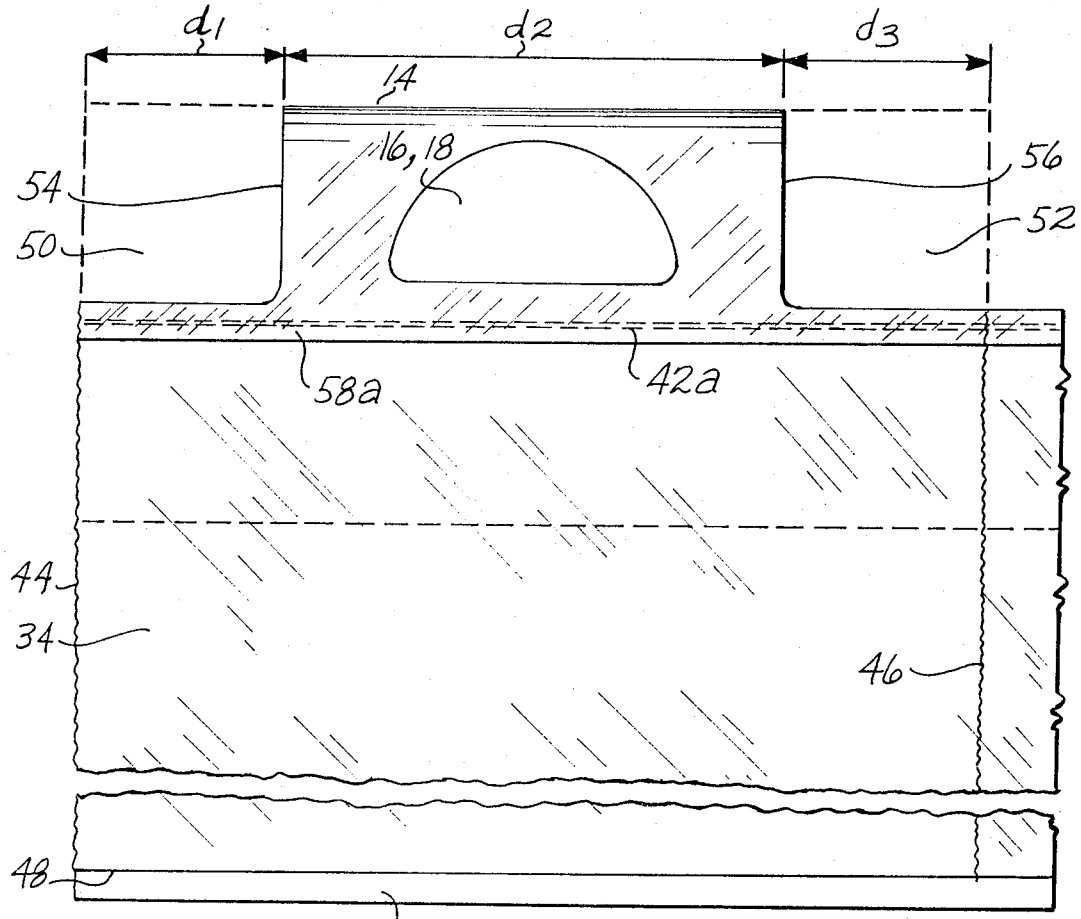
FIG. 3 is a plan view of the bag shown in FIG. 1, in a flattened or unfilled condition, with an intermediate portion of the bag web cut away to indicate indeterminate length, such view including phantom line showings of the bag and handle webs.

As shown by FIGS. 2 and 3, the side seals 44, 46 connect the side edges of the bag panels 34, 36 together, in a region of the bag extending from the gusset fold 32 down to the open end 48 of the bag. In the gusset region, the side seals 44, 46 connect together the side edges of the bag panels 34, 36 and the end edges of the gusset panels 38, 40. In the region where the handle web 14 is attached to the bag web 10, the side seals 44, 46 connect together the ends of the handle web 14, the ends of the gusset panels 38, 40, and the side edges of the bag panels 34, 36.

As is will known per se, a bag web that has been folded, cut and heat sealed in the manner described will assume a cubic shape when filled with contents having or capable of assuming such a shape, e.g. folded disposable baby diapers or adult briefs. The term "cubic" is used herein as it is used in the art, to mean a three dimensional figure with size sides of generally rectangular shape.

Referring to FIG. 2, in preferred form, the dimension along the inner surface of the bag material, measured from connecting seal **42*a* to connecting seal 42*b* is substantially equal to the dimension along the outer surface of the handle web 14, also measured from connecting seal 42 to connecting seal 42*b*. This places the central portion of the handle web 14 generally against the gusset 12 when the bag is packed and the gusset 12** is substantially flat.

Figure 5:
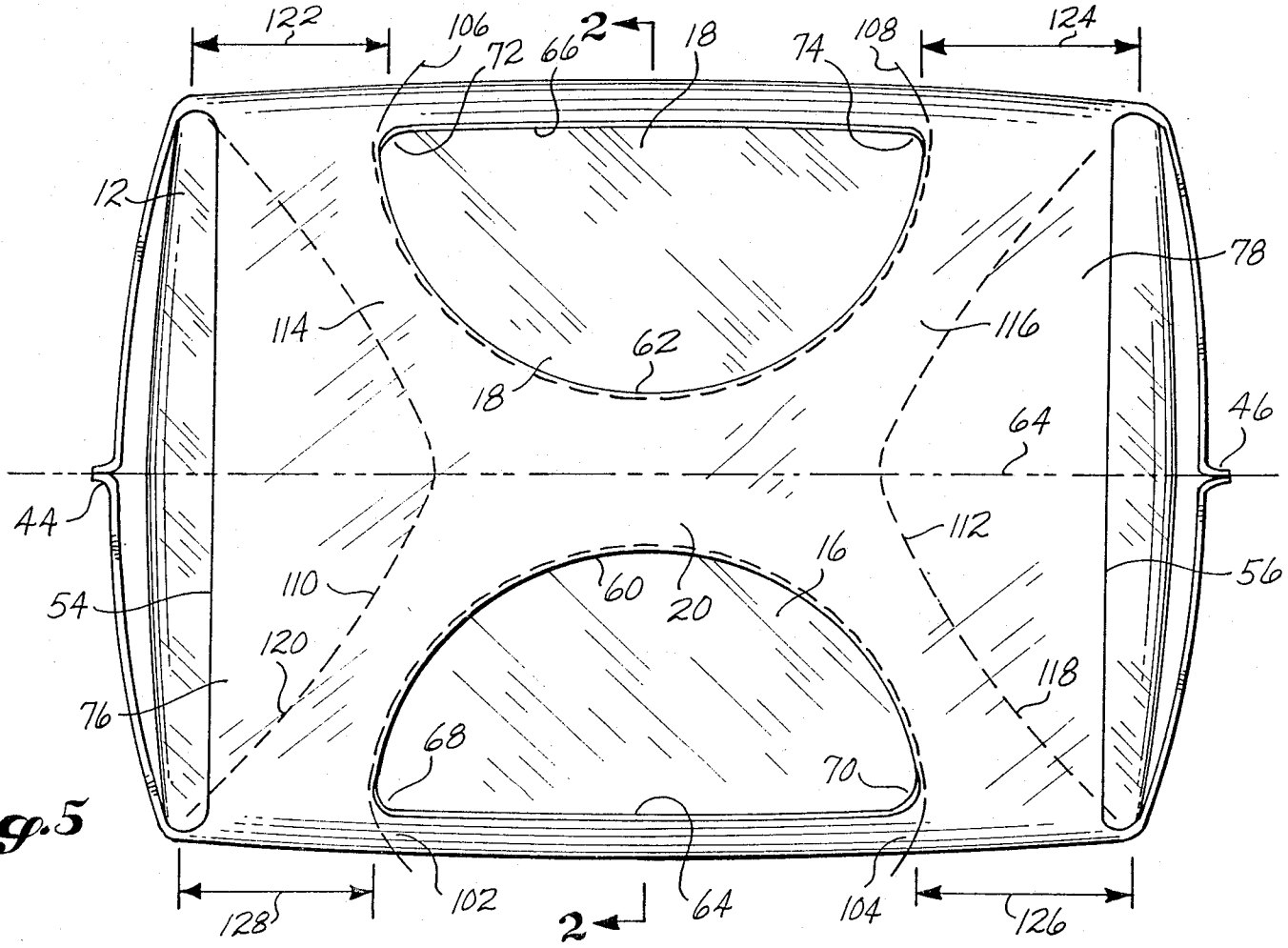
FIG. 5 is an enlarged scale top plane view of the bag shown by FIG. 1, such view including dash lines depicting stress boundaries in the handle web when the handle is carrying a load.
Figure 6:
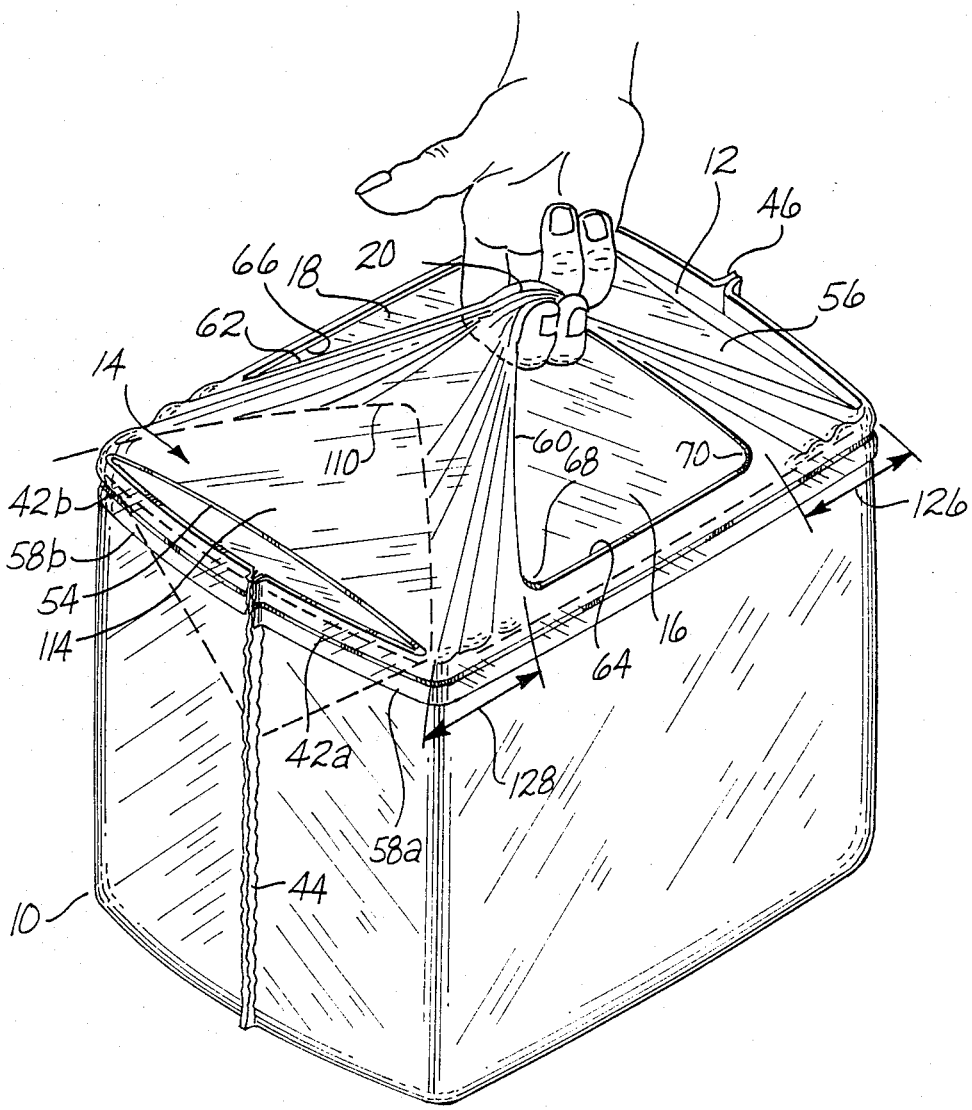
FIG. 6 is a view like FIG. 1, but showing the bag in the process of being lifted, and showing the inner boundaries of the hand openings being stretched in shape to each assume a substantially parabolic shape.

Referring to FIG. 3, the outer corner regions 50, 52 of the handle web 14 are cut away so as to define end boundary lines 54, 56. As shown by FIGS. 1, 5 and 6, the portion of the handle web 14 which is between the end boundaries 54, 56 substantially covers the gusset 18. The dimensions D1 are substantially equal to the distance from a corner of the filled bag 10 inwardly to a side seal 44, 46. The dimension D2 is substantially equal to the width dimension of the filled bag. This places the end boundaries 54, 56 of the central portion of the handle web 14 substantially at the end boundaries of the gusset 18 on a filled bag. As best shown by FIG. 3, on both sides of the filled bag the edge portions **58*a* and 58*b* of the handle web 14 extend along the full width of the bag, and in addition, extend around the corners to the heat seals 44, 46**.

According to the invention, each hand opening 16, 18 includes an arcuate side or boundary 60, 62 which is directed inwardly towards a centerline 64 which extends longitudinally of the handle web 14 and coincides with fold 32. The openings 16, 18 are arranged in mirror-like symmetry on opposite sides of the centerline 64. Preferably, each opening 16, 18 is substantially D-shaped and includes an outer side 64, 66 which is substantially straight. Each outer side is positioned relatively closely adjacent to a side boundary of the gusset 18 where it intersects its side of the filled bag. Opening 16 includes rounded fillet corners 68, 70 formed where the arcuate side 60 meets the straight side 64. In identical fashion, opening 18 includes rounded fillet corners 72, 74 where the arcuate side 62 meets the straight side 66. As best illustrated by FIG. 5, the corners 68, 70 and 72, 74 are positioned relatively adjacent the opposite sides of the gusset.

As best shown by FIG. 5, the strap handle 20 is located between the hand opening 16, 18 and extends longitudinally of the gusset 18. Each of its ends flare outwardly and merge into end portions 76, 78 of the handle web 14. These end regions extend both endwise outwardly and laterally outwardly of the opposite ends from the strap handle 20.

FIG. 8 is a fragmentary top plan view of the handle web 14' which has been provided with a pair of hand openings 80, 82 of conventional shape. These openings have generally straight opposite sides 84, 86 and generally semicircular ends 88. This type of hand hold pattern was tried and found to be inadequate. It was found that the web material behaved differently adjacent the opening which received the user's palm than it did adjacent the opening which received the user's fingers. Referring to FIG. 9, the material receiving the palm-receiving opening assumed an essentially flat shape at region 90. The region 92 which rested on the user's fingers was more rounded. It was found that the ends of the strap handle extended nearly vertically and high stress corner regions were formed at 94 and 96. There was a tendency for the material to tear at regions 94, 96. Also, the stress-carrying regions in the material were very narrow. It was discovered that the stress concentration in regions 98, 100 was somewhat less than in the regions 94, 96. It appeared this was because the upper boundary of the finger-receiving opening 80 took on a rounded shape. As a result of this observation, rounded top openings were tried. This led to the development of the openings 16, 18. The arcuate sides 60, 62 were given an initially circular shape. It was found that when openings of this shape were used, the boundaries of the openings 60, 62 would stretch when a filled package was picked up by the strap handle 20. The substantially semicircular boundaries 60, 62 became generally parabolic in shape. More importantly, an advantageous distribution of stress in the handle web was observed. Referring to FIG. 5, the arcuate edges 60, 62 of hand hold openings 16, 18 formed stress boundaries. These stress boundaries continued generally along lines 102, 104, 106, 108. Arcuate stress boundaries 110, 112 were observed in the end regions 76, 78 of the handle web 14. This formed a substantially X-shaped stress region which included the strap handle 20 at its center and tensioned regions of the handle web material 114, 116, 118, 120 extending from the ends of the handle 20 out to the corner regions 122, 124, 126, 128 of the filled bag. The handle web material stretched in these regions but without the formation of concentrated stress corners which promoted tear, such as was encountered with the use of hand openings of the conventional shape shown by FIGS. 8 and 9. It was also discovered that as stretching increased, so did the effective width of the tensioned regions 114, 116, 118, 120. Weight was added to a prototype bag. This increased both the stress and the stretch in stress-carrying regions 114, 116, 118, 120, and very clearly showed an increase in the width of the regions 114, 116, 118, 120. The filled bag evidenced a good distribution of bag weight to the four corners of the central portion of the handle web 14. At these corner regions 122, 124, 126, 128, there was a good distribution of bag weight from the bag material to the handle web corners, via the regions of the connecting seals **42*a*, 42*b* which extended through the bag corner regions 122, 124, 126, 128**.

As explained in the aforementioned article by A.G. Thatcher, the goods are loaded into the open end 48 of the bag and then that end of the bag is heat sealed shut.

The bag web 10 and the handle web 14 may be made from thermoplastic materials such as polyethylene, polypropylene, etc. The gauge or thickness of the webs 10, 14 may vary depending on the size of the bag and the weight of the bag contents. The handle web 14 may be transparent so that graphics can be placed on the gusset and these graphics can be seen through the handle web. Conversely, a colored and opaque handle web may be used, with or without graphics on it.

The bags are preferably cut from the connected webs 10, 14 by means of a hot knife 97, such as is disclosed in U.S. Pat. No. 3,283,994, granted Nov. 8, 1966, to Keeth B. Miller. This hot knife also forms the side seals 44, 46. The connecting seals **42*a*, 42*b* may be formed by sealing bars such as disclosed by Pat. No. 3,283,994, or by hot air sealers which are in common use today. The bag web 10** may be a laminate composed of an inner opaque layer which is printed and a transparent outer layer which is bonded to the inner layer and covers and protects the printing against scuffing, etc.

The embodiment of the invention which has been illustrated and described constitutes a preferred embodiment of the invention and is the best mode known to the inventor. However, the invention is not to be limited to this disclosed embodiment, but rather is to be determined by the appended claims, interpreted in accordance with established rules of patent claim interpretation, including use of the doctrine of equivalents.

What is claimed is:

1. A plastic bag with strap-type carrying handle, comprising:

a bag web of thermoplastic material folded laterally on itself to form front and rear panels and a top gusset between the panels at one end of the bag, said panels having parallel side edges, and said top gusset having end edges colinear with and positioned between upper portions of the side edges of the panels when the bag is flat and unfilled; and side seals connecting the side edges of the panels together, and further connecting the end edges of the top gusset together and to the upper portions of the side edges of the panels, in a manner resulting in the bag when filled assuming a carton shape and the gusset being substantially flat and forming a closed top for the bag; and a handle web of thermoplastic material having opposite edge portions and a central portion between said edge portions, overlying the top gusset, and connecting seals connecting the edge portions of the handle web to the front and rear panels of the bag web adjacent the top gusset, said central portion including a pair of substantially D-shaped hand openings, each having an arcuate side of continuous concave curvature, a substantially flat opposite side, and rounded corners where the arcuate side meets the substantially flat side, said hand openings being arranged in the central portion of the handle web in a mirror-like symmetry, with the substantially flat sides adjacent the connecting seals and the arcuate sides directed inwardly towards each other, said handle web including an elongated strap handle region located laterally between the openings and extending longitudinally of the top gusset, and opposite end regions endwise of the strap handle region extending both endwise and laterally outwardly to regions of the edge portions of the handle web which, when the bag is filled, are located at upper side corner regions of the bag.

2. A plastic bag with a strap-type carrying handle according to claim 1, wherein the opposite edge portions of the handle web extend the full width of the bag when it is flat and unfilled and have end edges which are sealed to each other, and to the bag web, at and by the side seals, and wherein the central portion of the web has end boundaries which are adjacent the ends of the top gusset when the bag is filled.

3. A plastic bag with carrying handle according to claim 1, wherein said arcuate side of each said hand opening has a substantially circular static shape and becomes substantially parabolic in shape when the handle is in use for carrying a filled bag.

4. A plastic bag with carrying handle, comprising:

a web of thermoplastic material folded laterally on itself to form front and rear panels and a top gusset between the panels at one end of the bag, said panels having parallel side edges, and said top gusset having end edges colinear with and positioned between upper portions of the side edges of the panels when the bag is flat and unfilled; and side seals connecting the side edges of the panels together, and further connecting the end edges of the top gusset together and to the upper portions of the side edges of the panels, in a manner resulting in the bag when filled assuming a carton shape and the gusset being substantially flat and forming a closed top for the bag; and a handle web of thermoplastic material having opposite edge portions and a central portion between said edge portions, overlying the top gusset, and connecting seals connecting the edge portions of the handle web to the front and rear panels of the bag web adjacent the top gusset, said central portion including a pair of hand openings, each having an arcuate side of concave curvature, an opposite side, and rounded corners where the arcuate side meets the opposite side, said openings being arranged in the central portion of the handle web in a mirror-like symmetry, with the arcuate sides being directed inwardly towards each other with the opposite sides being directed outwardly, and with the rounded corners positioned adjacent opposite sides of the gusset when the bag is filled, said handle web including an elongated strap handle region located laterally between the hand openings and extending longitudinally of the top gusset, and opposite end regions endwise of the strap handle region extending both endwise and and laterally outwardly to regions of the edge portions of the handle web which, when the bag is filled, are located at upper side corner regions of the bag.

* * * * *

UNITED STATES PATENT AND TRADEMARK OFFICE

CERTIFICATE OF CORRECTION

PATENT NO. : 4,867,575

DATED : September 19, 1989

INVENTOR(S) : Jerry W. Wood

It is certified that error appears in the above-identified patent and that said Letters Patent is hereby corrected as shown below:

Column 2, line 56, "plane" should be -- plan --.

Column 3, line 65, "size" should be -- six --.

Signed and Sealed this

Seventh Day of August, 1990

*Attest:*

HARRY F. MANBECK, JR.

*Attesting Officer*

*Commissioner of Patents and Trademarks*